US010266973B2

(12) United States Patent
Avio

(10) Patent No.: US 10,266,973 B2
(45) Date of Patent: Apr. 23, 2019

(54) COMPOSITE MATERIAL COMPRISING A WARP-KNITTED TEXTILE PANEL HAVING FIRST AND SECOND OPPOSING FACES, SAID FIRST FACE BEING COATED WITH A LAYER CONSISTING OF AT LEAST ONE POLYMER MATERIAL, AND A METHOD FOR THE PRODUCTION THEREOF

(71) Applicant: CARPENTIER & PREUX, Caudry (FR)

(72) Inventor: Bruno Avio, Marcq en Baroeul (FR)

(73) Assignee: CARPTENTIER & PREUX, Caudry (FR)

( * ) Notice: Subject to any disclaimer, the term of this patent is extended or adjusted under 35 U.S.C. 154(b) by 454 days.

(21) Appl. No.: 14/904,956

(22) PCT Filed: Jul. 10, 2014

(86) PCT No.: PCT/FR2014/051768

§ 371 (c)(1),
(2) Date: Jan. 14, 2016

(87) PCT Pub. No.: WO2015/007978

PCT Pub. Date: Jan. 22, 2015

(65) Prior Publication Data

US 2016/0153127 A1 Jun. 2, 2016

(30) Foreign Application Priority Data

Jul. 15, 2013 (FR) ..... 13 56962

(51) Int. Cl.
*D04B 21/06* (2006.01)

(52) U.S. Cl.
CPC ..... *D04B 21/06* (2013.01); *D10B 2403/0112* (2013.01); *D10B 2403/0122* (2013.01); *D10B 2505/18* (2013.01)

(58) Field of Classification Search
CPC ..... D04B 21/06; D10B 2403/0112; D10B 2403/0122; D10B 2505/18
See application file for complete search history.

(56) References Cited

U.S. PATENT DOCUMENTS 3,442,099 A 5/1969 Auville
3,884,053 A * 5/1975 Niederer ..... D04B 9/10 66/190

(Continued)

FOREIGN PATENT DOCUMENTS

EP 2308707 A1 4/2011

*Primary Examiner* — Cephia D Toomer
(74) *Attorney, Agent, or Firm* — Bookoff McAndrews, PLLC

(57) ABSTRACT

The present invention relates to a composite material comprising a warp-knitted textile panel having wales corresponding to the warp direction and courses corresponding to the weft direction, and first and second opposite faces, said first face being covered with a layer of at least one polymer material. Advantageously, each of said wales includes first stitches formed on every other course with a first yarn, and second stitches formed on every other course with a second yarn, the first and second stitches being alternated on every other course and being in opposite directions. In addition, in the weft direction, the first yarn and the second yarn each form stitches on every other course in alternation.

24 Claims, 3 Drawing Sheets

(56) References Cited

U.S. PATENT DOCUMENTS

| | | | | |
|---|---|---|---|---|
| 4,682,480 | A * | 7/1987 | Schnegg ..... | D04B 21/14<br>66/192 |
| 6,158,255 | A | 12/2000 | Ternon | |
| 2004/0152384 | A1 | 8/2004 | Ommerborn | |

* cited by examiner

| | |
|---|---|
| 0 | 0 |
| 1 | 0 |
| - | - |
| 1 | 1 |
| 1 | 0 |
| - | - |
| 2 | 0 |
| 1 | 0 |
| - | - |
| 1 | 1 |
| 1 | 0 |
FIG.6A
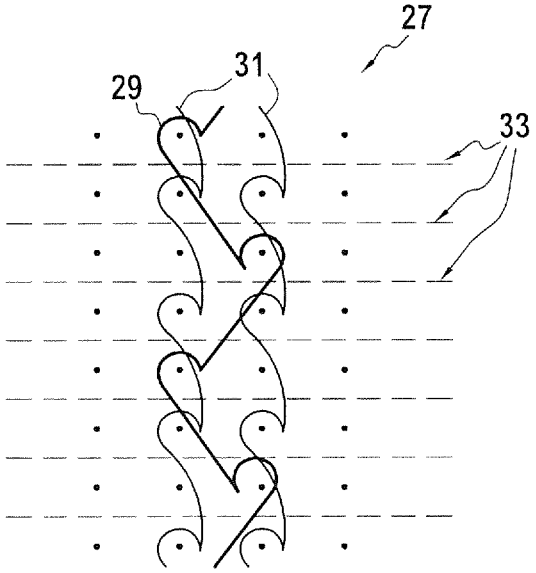
FIG.6B
| | |
|---|---|
| 1 | 0 |
| 0 | 0 |
| - | - |
| 1 | 1 |
| 1 | 0 |
| - | - |
| 1 | 0 |
| 2 | 0 |
| - | - |
| 1 | 1 |
| 1 | 0 |
FIG.7A
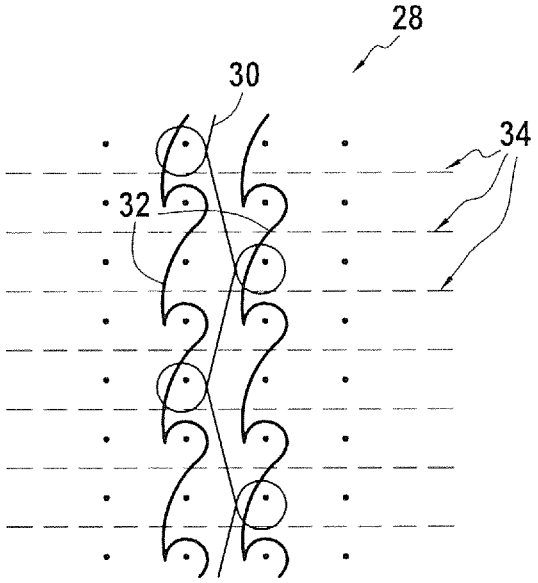
FIG.7B

COMPOSITE MATERIAL COMPRISING A WARP-KNITTED TEXTILE PANEL HAVING FIRST AND SECOND OPPOSING FACES, SAID FIRST FACE BEING COATED WITH A LAYER CONSISTING OF AT LEAST ONE POLYMER MATERIAL, AND A METHOD FOR THE PRODUCTION THEREOF

BACKGROUND OF THE INVENTION

The present invention relates to the technical field of composite materials comprising a warp-knitted textile panel, preferably including weft-inserted weft yarns, and coated on at least one of its faces with a layer of at least one polymer material.

Warp-knitted textile panels are thus used as reinforcement for the layer of at least one polymer material. These composite materials may be used as a protective cover, e.g. for swimming pools, as an advertising medium, as a luggage cover, as a roofing element, in particular for terraces, or as a self-adhesive strip. For a self-adhesive strip, the textile panel includes a film that is suitable for coming into contact with the adhesive layer without adhering to it.

A self-adhesive strip is known that includes a warp-knitted textile panel having weft yarns inserted at regular intervals. A drawback of that knitted panel is that it presents first and second opposite faces that are uneven. The lack of planeness of those faces makes it necessary to use a relatively large amount of polymer material in order to even out the faces and to obtain a composite material that is homogeneous. Furthermore, the shape of the wales of the knitted panel is visible in the adhesive layer, and that gives an unattractive aspect to the composite material.

This aspect may considerably hamper use of this type of knitted panel, which consists of composite material having a decorative function, such as for protective covers for swimming pools, luggage covers, advertising media, or roofing elements. Specifically, the wales create a stripy effect on the surface of composite material.

EP 0 978 583 A1 relates to an article having loops projecting from its surface suitable for acting as female fastener members in a fastener device of the hook and loop type. As shown in FIGS. 9 to 11 in particular, the wales are formed by means of two guide bars of a knitting machine working at the same time and on each course and not in alternation in such a manner that the first yarn and the second yarn form stitches on each of the courses and not on every other course. The wales present loops at regular intervals and thus form bulky projections. The surface of the material including those wales is therefore not even and plane and takes away a large amount of any polymer material layer that is applied to said surface, and does so in uneven manner.

The present invention thus provides a warp-knitted textile panel having first and second faces presenting planeness and uniformity that are improved, limiting the stripy effect of the wales in the layer of at least one polymer material, while satisfying the criteria for strength in the warp and weft directions in order to provide its primary function of reinforcement.

SUMMARY OF THE INVENTION

In a first aspect, the present invention provides a composite material comprising a warp-knitted textile panel having wales corresponding to the warp direction and courses corresponding to the weft direction and first and second opposite faces, said first face being covered with a layer of at least one polymer material. Advantageously, each of said wales includes first stitches formed on every other course with a first yarn, and second stitches formed on every other course with a second yarn, the first and second stitches being alternated on every other course and being in opposite directions. In addition, in the weft direction, the first yarn and the second yarn each form stitches on every other course in alternation, and said textile panel includes weft yarns inserted in the weft direction on every n out of p courses, n and p being integers, with n being less than or equal to p.

Advantageously, using two yarns to form the first and second alternate stitches on a wale, on every other course, makes it possible to halve the fineness of the single knit yarn used in the warp-knitted textile panels of the prior art and thus to improve the planeness and the uniformity of the textile panel. Furthermore, the thickness of said knitted panel is also reduced. Advantageously, the strength of the knitted panel of the invention is substantially of the same order as that of prior art panels, since the overall fineness of knit yarn found in each wale for the panel of the invention is equal to the fineness of the single knit yarn in the prior art panel.

In addition, the characteristic according to which the first and second stitches are alternated and in opposite directions makes it possible to balance the sinker stitches and thus to improve planeness and geometrical uniformity of the wales.

Furthermore, the first yarn forms stitches on every other course and thus the second yarn does not form stitches thereon, and that improves planeness and uniformity of the knitted panel.

The warp-knitted textile panel of the invention is thus improved in order to receive a layer of at least one polymer material at least on its first face, the resulting composite has a more even surface state and has better planeness, which also makes it possible to reduce the amount of said layer, and therefore represents a substantial saving on the finished composite.

The weft yarns may be multifilament yarns and/or monofilament yarns, preferably multifilament yarns. The composition of the weft yarns is a function of the purpose of the composite material.

Preferably, the weft yarns are inserted in the range every course to one course in every four, in particular in the range every course to every other course.

Depending on the knit weave, the weft yarns make it possible to assemble the wales together, in order to improve the strength of the knitted textile panel and to control the size of the openings made in the panel as a function of the number of weft yarns inserted per centimeter in the warp direction.

Preferably, the number of weft yarns inserted per centimeter (cm) in the warp direction lies in the range 1 yarn/cm to 25 yarns/cm, preferably in the range 1 yarn/cm to 18 yarns/cm.

Preferably, the number of stitches in the weft direction of the warp-knitted textile panel lies in the range 6 wales/inch to 46 wales/inch, more preferably in the range 6 wales/inch to 40 wales/inch.

By definition, a weft yarn does not form a stitch but is simply inserted in the weft direction so as to be substantially perpendicular to the warp direction.

In the present text, the term "knitting guide bar" is used to refer to a needle guide bar of a knitting machine. The knitting machine used in the context of the invention therefore works with at least two needle guide bars working in alternation. Thus, when a needle guide bar supporting the first yarn is working, the other needle guide bar supporting the second yarn is not working, the first and second stitches are thus obtained in alternation as defined in the invention.

The first and second stitches may be open or closed stitches.

Preferably, in the meaning of the present invention, "a layer of at least one polymer material" should be understood as referring to any continuous or discontinuous layer. The term "discontinuous layer" should be understood as being a layer comprising said polymer material arranged in discontinuous manner in patterns that may optionally be arranged in regular manner on said first face, e.g. in dots, in columns, or in any other geometrical pattern.

The term "continuous layer" should be understood as being a layer of optionally uniform thickness that is applied on the entire first face of the textile panel.

Said layer of the invention may be applied on the first face and/or on said second face of the textile panel by means of any technique known to the person skilled in the art, and in particular by knife coating, point coating, spraying, laminating said layer, or also impregnation.

Said at least one polymer material of the layer applied on the first face of the textile panel may be the same or different from said at least one polymer material of the layer applied on the second face of the textile panel.

Preferably, when the first face and the second face of the textile panel are each covered with the same layer comprising at least one polymer material, the textile panel is embedded in said layer.

The first and second yarns may be multifilament yarns and/or monofilament yarns, preferably multifilament yarns.

The compositions of the first and second yarns are determined as a function of the purpose of the composite material.

In addition, said at least one polymer material in said layer is determined as a function of the purpose of the composite material.

The warp-knitted panel of the invention may be knitted on a tricot warp knitting machine with weft insertion, a Raschel knitting machine with weft insertion, or also a crocheting machine.

Preferably, the textile panel of the invention is substantially plane, in particular flat knitted.

Said layer of at least one polymer material may include various additives such as pigments, or fillers, e.g. titanium dioxide.

In a variant, said warp-knitted textile panel includes first and second stitches, which form chain-stitches and extend along a wale.

In this event, it is necessary to provide weft yarns inserted in the stitches of the first and second stitches in order to gather the wales together. This arrangement is preferred for manufacturing knitted panels having openwork, in particular having at least one dimension of 1 millimeter (mm) or more.

Advantageously, this arrangement makes it possible to manufacture textile panels that are breakable manually in at least one direction, i.e. in the warp direction and/or in the weft direction.

Moreover, the fact that there are no tricot stitches in said panel further improves planeness. Indeed, the weft yarns providing the connection between the wales have a substantially rectilinear direction, since they pass through the stitches of the courses. In contrast, when the yarns of the tricot stitches extend along at least two adjacent wales so as to connect the wales together, they do not have a rectilinear path because they are knitted.

Said chain stitches may be open or closed stitches.

In an alternative, the first stitches are chain stitches and the second stitches are tricot stitches extending along at least two adjacent wales.

In this event, since the second stitches extend along at least two wales, the weft yarns are not necessary for assembling the wales together. However, the weft yarns may be inserted if it is desired to improve the strength of the knitted panel.

In advantageous manner, it should also be observed that the weft yarns provide more elasticity to the knitted textile panel when tricot stitches are present. Indeed, when the layer of at least one polymer material is placed on the first face of the textile panel, the shrinkage behavior during the heat treatment of the assembly formed by said layer and said panel is uniform. Indeed, the textile panel shrinks to match the shrinkage of the layer of at least one polymer material, which improves cohesion and facilitates assembly of the composite material of the invention.

Said chain stitches may be open or closed stitches.

In an alternative, the first and second stitches are tricot stitches extending along at least two adjacent wales.

The above-described technical effect concerning the behavior on shrinkage of the composite material is also found in this variant.

In this event, since the first and second stitches extend along at least two wales, the weft yarns are not necessary for assembling the wales together. The weft yarns may however be inserted if it is desired to improve the strength of the knitted panel.

In a variant, the number of stitches in the warp direction of the warp-knitted textile panel lies in the range 1 stitch/cm to 25 stitches/cm, preferably in the range 1 stitch/cm to 18 stitches/cm.

In a variant, the first yarn, the second yarn, and possibly the weft yarn, are multifilament yarns and/or monofilament yarns, preferably selected independently from among: polyethylene terephthalate (polyester); polyamide 6-6; polyamide 4-6; polyamide 6; polyethylene; polypropylene; polyacrylic; polypropylene.

In a variant, the first yarn, the second yarn, and possibly the weft yarn, have a fineness that is greater than or equal to 7 decitex (dtex) and less than or equal to 3000 dtex, more preferably greater than or equal to 10 dtex.

Preferably, the fineness of the first, second, and third yarns is greater than or equal to 22 dtex and less than or equal to 1000 dtex.

In a variant, the layer comprises at least one polymer material selected from the list including: polyurethane; polyethylene terephthalate (polyester); polyamide 6-6; polyamide 6; polyamide 4-6; polyvinyl chloride; a fluorinated polymer, such as polytetrafluoroethylene (PTFE), polyvinylidene fluoride (PVDF); ethylene-vinyl acetate (EVA).

In a second aspect, the present invention provides a method of manufacturing a composite material according to any of the above-described variants, comprising the following steps:

a) a step of knitting a warp-knitted textile panel having first and second opposite faces, and wales and courses, on a knitting machine having two guide bars, each respectively supporting a first yarn and a second yarn in order to knit each wale, the two guide bars working in alternation and in opposite directions so that each of said wales comprises first stitches formed on every other course with a first yarn, and second stitches formed on every other course with a second yarn, the first and second stitches being alternated on every other course and in opposite directions, in the weft direction, the first yarn and the second yarn each form stitches on every other course in alternation, and said textile panel (11, 17, 20, 23, 27, 28) includes weft yarns (26) inserted in the weft direction on every n out of p courses, n and p being integers, with n being less than or equal to p;

b) a step of coating one of said faces of said textile panel in a layer comprising at least one polymer material.

In a variant, the method includes a step of inserting weft yarns in the weft direction at every n out of p courses, n and p being integers, with n being less than or equal to p.

Preferably, the first and second stitches extend along a wale.

Preferably, the first and second stitches are open or closed chain stitches in opposite directions.

In a third aspect, the present invention provides a self-adhesive strip that is breakable manually in at least one direction, the strip including a composite material according to any of the above-described variants, in particular in the first and/or second aspect of the invention, comprising a warp-knitted textile panel having first stitches and second stitches extending along a wale and including weft yarns inserted in the weft direction at regular intervals on every n out of p courses, n and p being integers with n being less than or equal to p, said layer comprises at least one self-adhesive polymer material, and the second face of said knitted textile panel, possibly covered with said layer, is covered with a plastics film.

The strip of interlining has longitudinal and transverse directions, said strip being breakable in at least one of these directions, preferably in the transverse direction.

Preferably, the first and second faces of said textile panel are covered with said layer comprising at least one self-adhesive polymer material, in particular so that said panel is embedded in said layer.

In another variant, when the second face is also covered with a layer of at least one polymer material, said polymer material may be the same or different from at least one polymer material of the layer covering the first face of the textile panel.

In the present invention, the term "plastics film" should be understood as referring to any synthetic film suitable for coming into contact with said layer of self-adhesive polymer material without adhering thereto. Said plastics film may thus be made of polyethylene terephthalate, vinyl polychloride, polypropylene, or also polyethylene, or also silicone, e.g. said silicone film forms part of a silicone treated paper.

Said self-adhesive polymer material may be a polyacrylic adhesive and in general be made from any material known to the person skilled in the art that is suitable for acting as a self-adhesive polymer, e.g. polyurethane.

Said self-adhesive polymer material may be an adhesive that is permanent or it may be repositionable.

In a sub-variant, the textile panel is covered along a first face of a layer comprising at least one permanent self-adhesive polymeric material and along a second face of a layer comprising at least one repositionable self-adhesive polymer material.

Preferably, the first face and/or the second face is/are covered with a plastics film, in particular with a silicone treated paper.

In a fourth aspect, the present invention provides a strip of interlining comprising a composite material according to any of the above-described variants, said layer comprising at least one thermofusible polymer material.

A strip of interlining is generally used when making items of clothing to give strength to a particular area of the item, such as the collar, to assemble textile panels together, or to hide seam zones.

Said thermofusible polymer material may be any polymer material known to the person skilled in the art and suitable for melting under the effect of heat. For example, said thermofusible polymer material may be a polyamide 6 polymer or also a polyamide 6-6 polymer.

In a fifth aspect, the present invention provides a strip of interlining comprising a composite material according to any of the above-described variants, said layer comprising at least one self-adhesive polymer material.

Said self-adhesive material may be an adhesive, such as a polyacrylic adhesive.

In a sixth aspect, the present invention provides: a protective cover; an advertising medium; a luggage cover; or a roofing unit including a composite material according to any of the above-mentioned alternative embodiments, having said layer comprising at least one polymer material that is resistant to abrasion, the textile panel being embedded in said layer so that its first and second faces are covered with said layer. The second face of said textile panel is advantageously water-resistant.

Said layer of at least one polymer material may thus be dope pigmented by adding one or more polymer pigments or dyes before being applied to said knitted textile panel.

Said layer of at least one polymer material may also be printed, in particular for advertising media, for example by inkjet printing.

The layer of at least one polymer material possibly comprises polyvinyl chloride, and may be applied by scraper to said textile panel. Depending on its purpose, the textile panel covered with said layer may further be covered on its first and/or second face with a plastics film.

DETAILED DESCRIPTION OF THE DRAWINGS

FIG. 6A is a diagram showing the work of the two guide bars of a knitting machine for a wale of a fifth example of a textile panel of the invention;

FIG. 6B is a diagram showing the knit weave of the fifth example of the textile panel shown in FIG. 6A;

FIG. 7A is a diagram showing the work of the two guide bars of a knitting machine for a wale of a sixth example of a textile panel of the invention; and FIG. 7B is a diagram showing the knit weave of the sixth example of the textile panel shown in FIG. 7A.

DETAILED DESCRIPTION OF EXAMPLE EMBODIMENTS

Figure 1A:
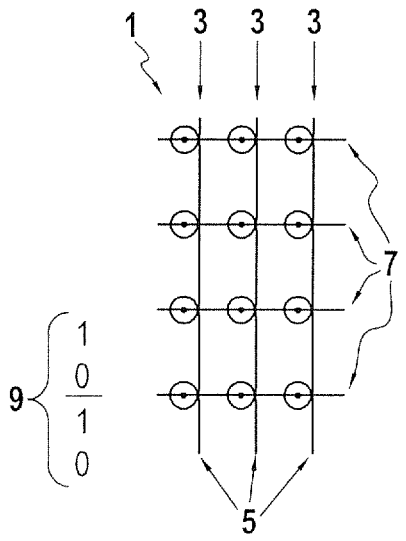
FIG. 1A is a diagram showing a first example of a knit weave of a textile panel of the prior art.
Figure 1B:
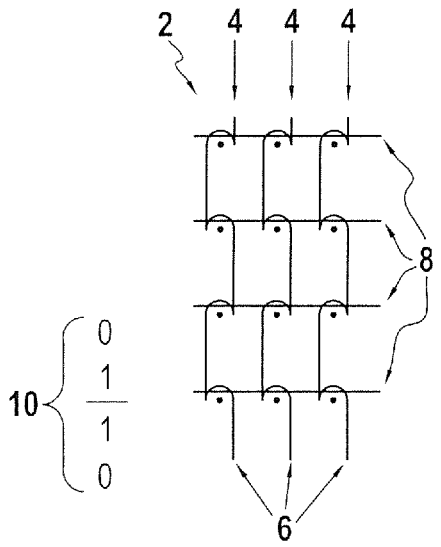
FIG. 1B is a diagram showing a second example of a knit weave of a textile panel of the prior art.

The FIGS. 1A and 1B show knit weaves 1, 2 of warp-knitted textile panels of the prior art. In these two weaves 1, 2, each wale 3, 4 is obtained by knitting a single yarn 5, 6. One single guide bar per wale is therefore necessary. Weft yarns 7, 8 are inserted through the stitches for each course so as to secure the wales 3 together with the wales 4. The knit weaves 1 and 2 show three wales 3 and 4, and four courses respectively. The numbers of wales and courses were determined arbitrarily for representation purposes. The needles are represented by dots.

The FIG. 1A shows closed chain stitches, while FIG. 1B shows open chain stitches. In FIG. 1A the knit yarn 5 in the open stitches configuration turns around the needle from left to right, then from right to left at the following course. In FIG. 1B, the knit yarn 6 always turns in the same direction around the needle. Unevenness may thus be observed between the bottom half-arcs of the stitches of two adjacent courses. References 9 and 10 specify the movements of the bars supporting the knit yarns 5 and 6.

By way of non-limiting example, a warp-knitted textile panel of the prior art obtained by implementing the knit weave shown in FIG. 1A or FIG. 1B with a knit yarn of 50 dtex, a number of stitches in the warp direction of approximately 2.9 stitches/cm, and a weft yarn of 167 dtex inserted on every course, has a thickness of 168 micrometers (μm) for a weight per square meter of 17 grams per square meter ($g/m^2$).

Figure 2A:
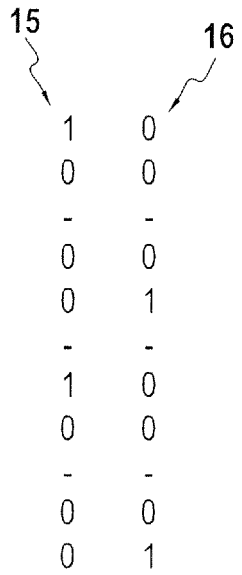
FIG. 2A is a diagram showing the work of the two guide bars of a knitting machine for a wale of a first example of a textile panel of the invention.
Figure 2B:
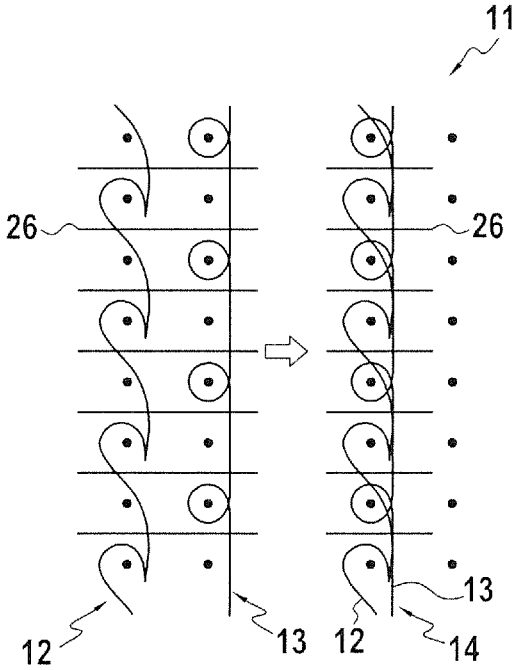
FIG. 2B is a diagram showing the knit weave of the first example of the textile panel shown in FIG. 2A.

The first example of a warp-knitted panel of the invention having a knit weave 11 that is shown in FIG. 2B includes wales, each comprising first stitches formed on every other course with a first yarn 12 and second stitches formed on every other course with a second yarn 13, the first and second stitches being alternated on every other course and being in opposite directions. The first yarn 12 and the second yarn 13 each form stitches on every other course in alternating manner. Therefore, the first yarn 12 forms no stitch on every other course, and the same applies to the second yarn 18. This arrangement contributes to the planeness of the textile panel. The stitches formed by the knit yarns 12 and 13 are shown separately in FIG. 2B, but are arranged in the first example of a knitted panel along the wale 14. The knit yarn 12 forms open chain stitches while the knit yarn 13 forms closed chain stitches. The first column 15 of FIG. 2A shows the movement of the guide bar supporting the knit yarn 12 for forming a given wale such as the wale 14. The column 16 of FIG. 2A shows the movement of the guide bar supporting the knit yarn 13 for forming said given wale, such as the wale 14. Unlike the panels of the prior art shown by the knit weaves 1 and 2 in FIGS. 1A and 1B in which each wale is formed only by using a single guide bar supporting one yarn, each wale of the first example of a warp-knitted panel thus includes two knit yarns.

FIGS. 3A to 7A show various alternatives of the guide bar movement diagrams, for each one of these diagrams, two guide bars each supporting a knit yarn form each wale of the textile panels of the invention.

Figure 3A:
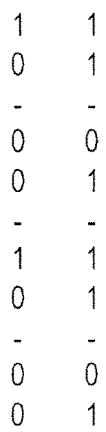
FIG. 3A is a diagram showing the work of the two guide bars of a knitting machine for a wale of a second example of a textile panel of the invention.
Figure 3B:
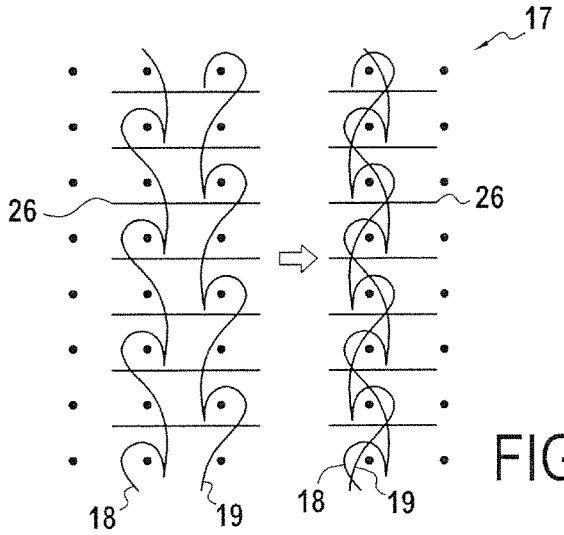
FIG. 3B is a diagram showing the knit weave of the second example of the textile panel shown in FIG. 2A.

In FIG. 3B, the knit weave 17 comprises knit yarns 18 and 19 forming open chain stitches in opposite directions.

Figure 4A:
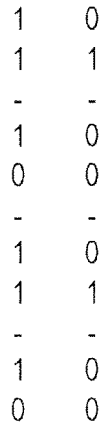
FIG. 4A is a diagram showing the work of the two guide bars of a knitting machine for a wale of a third example of a textile panel of the invention.
Figure 4B:
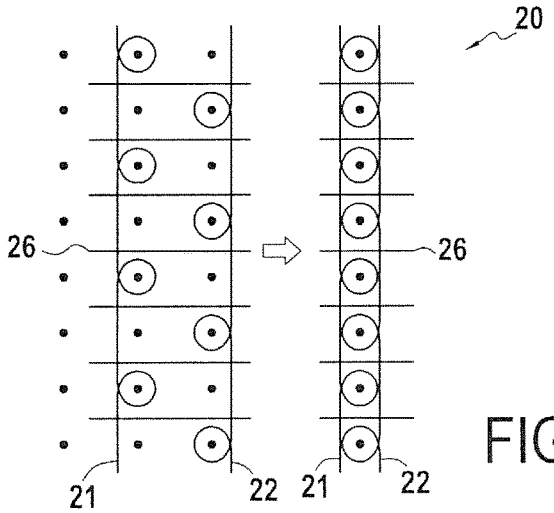
FIG. 4B is a diagram showing the knit weave of the third example of the textile panel shown in FIG. 4A.
Figure 5A:
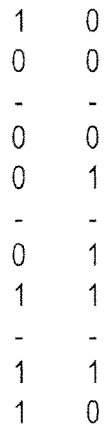
FIG. 5A is a diagram showing the work of the two guide bars of a knitting machine for a wale of a fourth example of a textile panel of the invention.
Figure 5B:
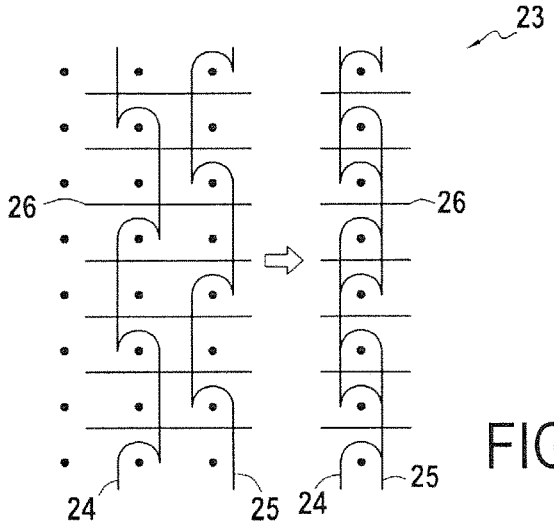
FIG. 5B is a diagram showing the knit weave of the fourth example of the textile panel shown in FIG. 5A.

In FIG. 4B, the knit weave 20 comprises knit yarns 21 and 22 forming closed chain stitches in opposite directions. In FIG. 5B, the knit weave 23 comprises two knit yarns 24 and 25 forming open chain stitches in opposite directions.

The knit weaves 11, 17, 20, and 23 comprise first and second stitches extending along only one wale at the same time so that weft yarns 26 are necessary in order to assemble the wales of the textile panels together resulting therefrom and in order to improve the strength of said panels.

The knit weaves 27 and 28 shown in FIGS. 6B and 7B comprise respective first stitches formed with a first knit yarn 29 and 30 extending along two adjacent wales and respective second stitches formed with a second yarn 31 and 32 extending along a single wale only. The second knit yarn 31 forms open chain stitches opposite the knit stitches formed by the first knit yarn 29. The first knit yarn 30 forms knit stitches opposite the open chain stitches formed by the second knit yarn 32. When the knit weaves 27 and 28 do not comprise weft yarns, the connection between the wales is provided by the first knit yarns 29 and 30 extending between two adjacent wales. The inventors have nevertheless observed in surprising manner that the arrangement of weft yarns 33 and 34 on the knit weaves, shown in FIGS. 6B and 7B respectively in dashed lines, makes it possible to improve the shrinkage behavior of the textile panel resulting therefrom during the heat treatment associating it with a layer of at least one polymeric material. According to the sought-after behavior of the composite material, weft yarns may thus be inserted in the weft direction.

In the examples shown in FIGS. 3B to 7B, the first yarns 18, 21, 24, 29, and 30 firstly and the second yarns 13, 19, 22, 25, 31, and 32 secondly, each form stitches on every other course in alternating manner since the two guide bars form stitches in alternating manner.

In a precise example, given by way of non-limiting example, a warp-knitted textile panel obtained by implementing any of the knit weaves 11, 17, 20, or 23 using first and second multifilament yarns of 25 dtex each, and a multifilament weft yarn of 167 dtex, presents thickness of about 115 μm for a weight/$m^2$ of 11 $g/m^2$. The textile panel of the invention thus has thickness that is reduced by 30% relative to the thickness of 168 μm of a prior art panel.

The implementation of the warp-knitted textile panel of the invention obtained in this way as a manually breakable self-adhesive strip requires only approximately 33 $g/m^2$ of a layer of adhesive polymer material compared to 45 $g/m^2$ for a warp-knitted textile panel of the prior art. The uniformity of the first and second faces of the textile panel of the invention makes it possible, at equivalent strengths, to improve the surface state of the textile panel and consequently to reduce the amount of the layer of polymer material, made of self-adhesive polymer in this precise example.

The invention claimed is:

1. A composite material comprising a warp-knitted textile panel having wales corresponding to the warp direction and courses corresponding to the weft direction, and first and second opposite faces, said first face being covered with a layer of at least one polymer material, wherein each one of said wales includes first stitches formed on every other course with a first yarn, and second stitches formed on every other course with a second yarn, the first and second stitches being alternated on every other course and being in opposite directions, and wherein, in the weft direction, the first yarn and the second yarn each form stitches on every other course in alternation, and in that said textile panel includes weft yarns inserted in the weft direction on every n out of p courses, n and p being positive integers, with n being less than or equal to p.

2. The composite material according to claim 1, wherein said textile panel includes first and second stitches, which are chain stitches, and that extend along a wale.

3. The composite material according to claim 1, wherein said textile panel includes first stitches, which are chain stitches, and second stitches, which are tricot stitches, extending along at least two adjacent wales.

4. The composite material according to claim 1, wherein said textile panel includes first and second stitches, which are tricot stitches, extending along at least two adjacent wales.

5. The composite material according to claim 1 wherein the number of stitches in the warp direction of the textile panel lies in the range 1 stitch/cm to 25 knit stitches/cm.

6. The composite material according to claim 1, wherein the number of stitches in the weft direction of the textile panel lies in the range 6 wales/inch to 46 wales/inch.

7. The composite material according to claim 1, wherein the first yarn and the second yarn comprise multifilament yarns and/or monofilament yarns.

8. The composite material according to claim 1, wherein the first yarn and, the second yarn have a fineness that is greater than or equal to 7 dtex and less than or equal to 3000 dtex.

9. The composite material according to claim 1, wherein the layer comprises at least one polymer material selected from the list including: polyurethane; polyamide 6-6; polyamide 6; polyamide 4-6; polyvinyl chloride; a fluorinated polymer; ethylene-vinyl acetate (EVA).

10. The composite material according to claim 5, wherein the number of stitches in the warp direction of the textile panel lies in the range 1 stitch/cm to 18 stitches/cm.

11. The composite material according to claim 6, wherein the number of stitches in the weft direction of the textile panel lies in the range 6 wales/inch to 40 wales/inch.

12. The composite material according to claim 1, wherein the first yarn, the second yarn and the weft yarn are selected independently from among: polyethylene, terephthalate, polyamide 6-6, polyamide 4-6, polyamide 6, polyethylene, polypropylene, polyacrylic, polypropylene.

13. The composite material according to claim 1, wherein the weft yarn has a fineness that is greater than or equal to 7 dtex and less than or equal to 3000 dtex.

14. A method of manufacturing a composite material according to claim 1, comprising the following steps:

a) a step of knitting a warp-knitted textile panel having first and second opposite faces, and wales and courses, on a knitting machine having two guide bars, each respectively supporting a first yarn and a second yarn in order to knit each wale, the two guide bars working in alternation and in opposite directions so that each of said wales comprises first stitches formed on every other course with said first yarn, and second stitches formed on every other course with said second yarn, the first and second stitches being alternated on every other course and in opposite directions, wherein, in the weft direction, the first yarn and the second yarn each form stitches on every other course in alternation, and wherein said textile panel includes weft yarns inserted in the weft direction, the first yarn and the second yarn each form stitches on every other course in alternation, and wherein said textile panel includes weft yarns inserted in the weft direction on every n out of p courses, n and p being positive integers, with n being less than or equal to p;

b)a step of coating one of said faces of said textile panel in a layer comprising at least one polymer material.

15. A self-adhesive strip that is breakable manually in at least one direction, wherein the strip includes a composite material according to claim 2, wherein said layer of at least one polymer material comprises at least one self-adhesive polymer material, and wherein the second face of said knitted textile panel is covered with a plastics film.

16. A self-adhesive strip that is breakable manually in at least one direction wherein the strip includes a composite material according to claim 3, wherein said layer of at least one polymer material comprises at least one self-adhesive polymer material, and wherein the second face of said knitted textile panel is covered with a plastics film.

17. A strip of interlining, wherein it includes a composite material according to claim 1, and wherein the said layer of at least one polymer material comprises at least one thermofusible polymer material.

18. A strip of interlining, comprising a composite material according to claim 1, and wherein the said layer of at least one polymer material comprises at least one self-adhesive polymer material.

19. A protective cover comprising a composite material according to claim 1, and wherein the said layer of at least one polymer comprises at least one polymer material that is resistant to abrasion, wherein the textile panel is embedded in said layer so that its first and second faces are covered with said layer, and wherein the second face of the textile panel is water-proof.

20. The composite material according to claim 1, wherein the weft yarn comprises multifilament yarn and/or monofilament yarn.

21. The composite material according to claim 9, wherein the at least one polymer comprises polytetrafluoroethylene (PTFE), polyvinylidene fluoride (PVDF), or both.

22. An advertising medium comprising a composite material according to claim 1, wherein the said layer of at least one polymer material comprises at least one polymer material that is resistant to abrasion, wherein the textile panel is embedded in said layer so that its first and second faces are covered with said layer, and wherein the second face of the textile panel is water-proof.

23. A luggage cover comprising a composite material according to claim 1, wherein the said layer of at least one polymer material comprises at least one polymer material that is resistant to abrasion, wherein the textile panel is embedded in said layer so that its first and second faces are covered with said layer, and wherein the second face of the textile panel is water-proof.

24. A roofing element, comprising a composite material according to claim 1, wherein the said layer of at least one polymer material comprises at least one polymer material that is resistant to abrasion, wherein the textile panel is embedded in said layer so that its first and second faces are covered with said layer, and wherein the second face of the textile panel is water-proof.

* * * * *